US010578267B2

(12) United States Patent
Bowles et al.

(10) Patent No.: US 10,578,267 B2
(45) Date of Patent: Mar. 3, 2020

(54) VEHICLE LAMP LIGHT ASSEMBLY

(71) Applicant: North American Lighting, Inc., Paris, IL (US)

(72) Inventors: Dean Bowles, Commerce, MI (US); Panakalu Vangala, Wixom, MI (US); Marc Bell, Ann Arbor, MI (US); Pavan Venkannagari, Farmington Hills, MI (US)

(73) Assignee: NORTH AMERICAN LIGHTING, INC., Paris, IL (US)

( * ) Notice: Subject to any disclaimer, the term of this patent is extended or adjusted under 35 U.S.C. 154(b) by 0 days.

(21) Appl. No.: 15/335,154

(22) Filed: Oct. 26, 2016

(65) Prior Publication Data

US 2018/0112844 A1 Apr. 26, 2018

(51) Int. Cl.
*F21S 41/47* (2018.01)
*F21S 41/39* (2018.01)
(Continued)

(52) U.S. Cl.
CPC ..... *F21S 41/47* (2018.01); *F21S 41/141* (2018.01); *F21S 41/148* (2018.01); *F21S 41/19* (2018.01);
(Continued)

(58) Field of Classification Search
CPC .... F21S 48/142; F21S 48/232; F21S 48/1305; F21S 48/147; F21S 43/19; F21S 43/37; F21S 41/47; F21S 41/19; F21S 41/435; F21S 41/43; F21S 41/40; F21S 41/148; F21S 41/39; F21S 41/336; F21S 41/141;
(Continued)

(56) References Cited

U.S. PATENT DOCUMENTS 7,794,126 B2 9/2010 Ishida et al.
8,579,484 B2 11/2013 Sugie
(Continued)

FOREIGN PATENT DOCUMENTS

AT 514048 A1 * 9/2014 ..... F21S 48/1104
EP 2573456 A1 * 3/2013 ..... F21S 48/1159
(Continued)

OTHER PUBLICATIONS

Sugie, Vehicle lighting device, 2013-03-027, EP2573456A1, English.*
(Continued)

*Primary Examiner* — Bryon T Gyllstrom
*Assistant Examiner* — James M Endo
(74) *Attorney, Agent, or Firm* — Brooks Kushman P.C.

(57) ABSTRACT

A vehicle lamp is provided with a housing and a transparent lens connected to the housing to define a lamp chamber there between. A reflector is disposed in the lamp chamber for reflecting light through the lens. An electrical board is disposed in the lamp chamber and oriented in relative to the reflector. A light emitting diode (LED) is mounted to the electrical board for emitting light. A light shade is mounted to the electrical board at a mounting feature defined at a predetermined location relative to the LED to block light rays emitted by the LED. The shade is soldered to the electrical board at the predetermined orientation relative to the LED and the light shade does not contact the reflector.

16 Claims, 5 Drawing Sheets

(51) Int. Cl.

| | |
|---|---|
| ***F21S 41/148*** | (2018.01) |
| ***F21S 41/33*** | (2018.01) |
| ***F21S 45/49*** | (2018.01) |
| ***F21S 45/47*** | (2018.01) |
| ***F21S 41/43*** | (2018.01) |
| ***F21S 43/37*** | (2018.01) |
| ***F21S 43/14*** | (2018.01) |
| ***F21S 43/19*** | (2018.01) |
| ***F21S 41/19*** | (2018.01) |
| ***F21S 41/141*** | (2018.01) |

(52) U.S. Cl.
CPC ..... *F21S 41/336* (2018.01); *F21S 41/39* (2018.01); *F21S 41/43* (2018.01); *F21S 43/14* (2018.01); *F21S 43/19* (2018.01); *F21S 43/37* (2018.01); *F21S 45/47* (2018.01); *F21S 45/49* (2018.01)

(58) Field of Classification Search
CPC .. F21S 41/68; F21V 1/24; F21V 13/10; F21V 11/16
See application file for complete search history.

(56) References Cited

U.S. PATENT DOCUMENTS 8,967,841 B2 3/2015 Bohm
2009/0168428 A1* 7/2009 Huang ..... F21S 41/147 362/294
2009/0257215 A1* 10/2009 Gomi ..... G02F 1/133605 362/97.1
2010/0033985 A1* 2/2010 Hsu ..... F21S 41/147 362/539
2011/0205735 A1* 8/2011 Suzuki ..... F21V 7/0008 362/235
2011/0249461 A1* 10/2011 Sugie ..... F21S 48/1159 362/516
2013/0027958 A1* 1/2013 Okubo ..... F21S 48/1364 362/512
2013/0033859 A1* 2/2013 Yaphe ..... F21V 5/007 362/223
2013/0039085 A1* 2/2013 Iwasaki ..... F21S 48/1159 362/516
2014/0098554 A1* 4/2014 Schimon ..... F21S 43/00 362/512
2014/0226355 A1* 8/2014 Blandin ..... F21S 48/1109 362/520
2014/0233245 A1* 8/2014 Kerpe ..... H05K 1/0209 362/341
2014/0347875 A1 11/2014 Huang
2014/0355286 A1* 12/2014 Arita ..... F21S 41/19 362/516
2015/0062948 A1* 3/2015 Otsubo ..... F21S 48/1104 362/518
2015/0070924 A1* 3/2015 Kadowaki ..... F21S 48/1104 362/517
2015/0241011 A1* 8/2015 Bauer ..... F21S 48/1159 362/514
2015/0267886 A1 9/2015 Cabanne et al.
2015/0369435 A1* 12/2015 Bauer ..... F21S 48/115 362/545

FOREIGN PATENT DOCUMENTS

EP 2947380 A2 11/2015
JP 2008198483 A 8/2008
JP 2014107025 A * 6/2014 ..... F21S 48/1159

OTHER PUBLICATIONS

Zorn, Light module for a vehicle headlamp, Sep. 15, 2014, AT514048/WO2014138763, English.*
Abe, Vehicular headlight, Jun. 9, 2014, JP2014107025, English.*

* cited by examiner

VEHICLE LAMP LIGHT ASSEMBLY

TECHNICAL FIELD

The present application relates to vehicle lamps, in particular vehicle lamps in which the light source is a light emitting diode (LED).

BACKGROUND

The light source in a vehicle lamp is positioned so that light is emitted towards a reflector and then light from the reflector is reflected and projected to a desired light distribution patter in a region in front of the vehicle lamp. However, even if the light source emits a precise beam, like a light emitting diode (LED), there may be some dispersion of light beams. To help inhibit the scattered light beams from being reflected outside the desired light distribution, a shade is positioned adjacent the light source to block the dispersed and scattered light beams.

SUMMARY

According to one embodiment, a vehicle lamp is provided with a housing and a transparent lens connected to the housing to define a lamp chamber there between. A reflector is disposed in the lamp chamber for reflecting light through the lens. An electrical board is disposed in the lamp chamber and oriented in relative to the reflector. A light emitting diode (LED) is mounted to the electrical board for emitting light. A shade is soldered to the electrical board at a predetermined orientation relative to the LED to block light rays emitted by the LED.

In another embodiment, the light shade does not contact the reflector.

In another embodiment, the light shade is soldered to the electrical board via a solder pad defined on the electrical board, wherein the light shade is oriented relative to the reflector based on a position of the solder pad.

In another embodiment, the electrical board is a printed circuit board.

In another embodiment, the electrical board comprises a flexible circuit board and a rigidizer.

In another embodiment, the light shade has an appearance surface finished to appear similar to a reflector surface.

According to one other embodiment, a vehicle lamp is provided with a housing and a transparent lens connected to the housing to define a lamp chamber there between. A reflector is disposed in the lamp chamber for reflecting light through the lens. A light assembly is disposed in the lamp chamber. The light assembly has an electrical board oriented relative to the reflector. A light emitting diode (LED) is disposed in the lamp chamber and mounted to the electrical board. A light shade is mounted to the electrical board at a mounting feature defined at a predetermined location relative to the LED to block light rays emitted by the LED, and the light shade does not contact the reflector.

In another embodiment, the light assembly is oriented relative to the reflector by aligning locating features on the electrical board with corresponding locating features the reflector.

In another embodiment, the predetermined location of the light shade is determined based on the locating feature on the electrical board.

In another embodiment, the light emitting diode (LED) is placed on the electrical board at a first mounting feature and the light shade is placed on the electrical board at a second mounting feature at a predetermined location relative to the first mounting feature. The first and second mounting features are based on the locating feature defined on the electrical board thereby ensuring the LED and light shade are positioned at predetermined locations relative to the reflector when the locating features on the electrical board are aligned with the corresponding locating features the reflector.

In another embodiment, the locating features comprise mounting apertures.

In another embodiment, a support structure has a locating pin extending therefrom. The locating pin extends through and aligns the mounting apertures to position the LED and light shade relative to the reflector.

According to one other embodiment a light assembly is provided. An electrical board. A light emitting diode (LED) is mounted to an electrical board. A shade is soldered to the electrical board at a predetermined orientation relative to the LED. The shade forms an enclosure that partially blocks light from the LED from projecting outside the enclosure.

In another embodiment, the enclosure has a blocking surface with a projection-pattern edge. A first portion of light from the LED is projected past the projection-pattern edge and a second portion of light from the LED is blocked by the blocking surface.

In another embodiment, the blocking surface is offset from the electrical board and is not soldered to the electrical board.

In another embodiment, the blocking surface has a projection-pattern edge oriented at a predetermined distance from a focal point of the LED.

In another embodiment, the enclosure is defined by at least four surfaces.

In another embodiment, the shade is soldered to the electrical board along an edge defined by at least three of the enclosure surfaces.

In another embodiment, a method of assembling the light assembly is provided. The method includes placing, with a robotic machine, a light emitting diode (LED) on the electrical board at a first mounting feature. The light shade is placed, with the robotic machine, on the electrical board at a second mounting feature at a predetermined location relative to the first mounting feature.

In another embodiment, the method of assembling the light assembly includes soldering the LED and shade to the electrical board.

DETAILED DESCRIPTION

Figure 1:
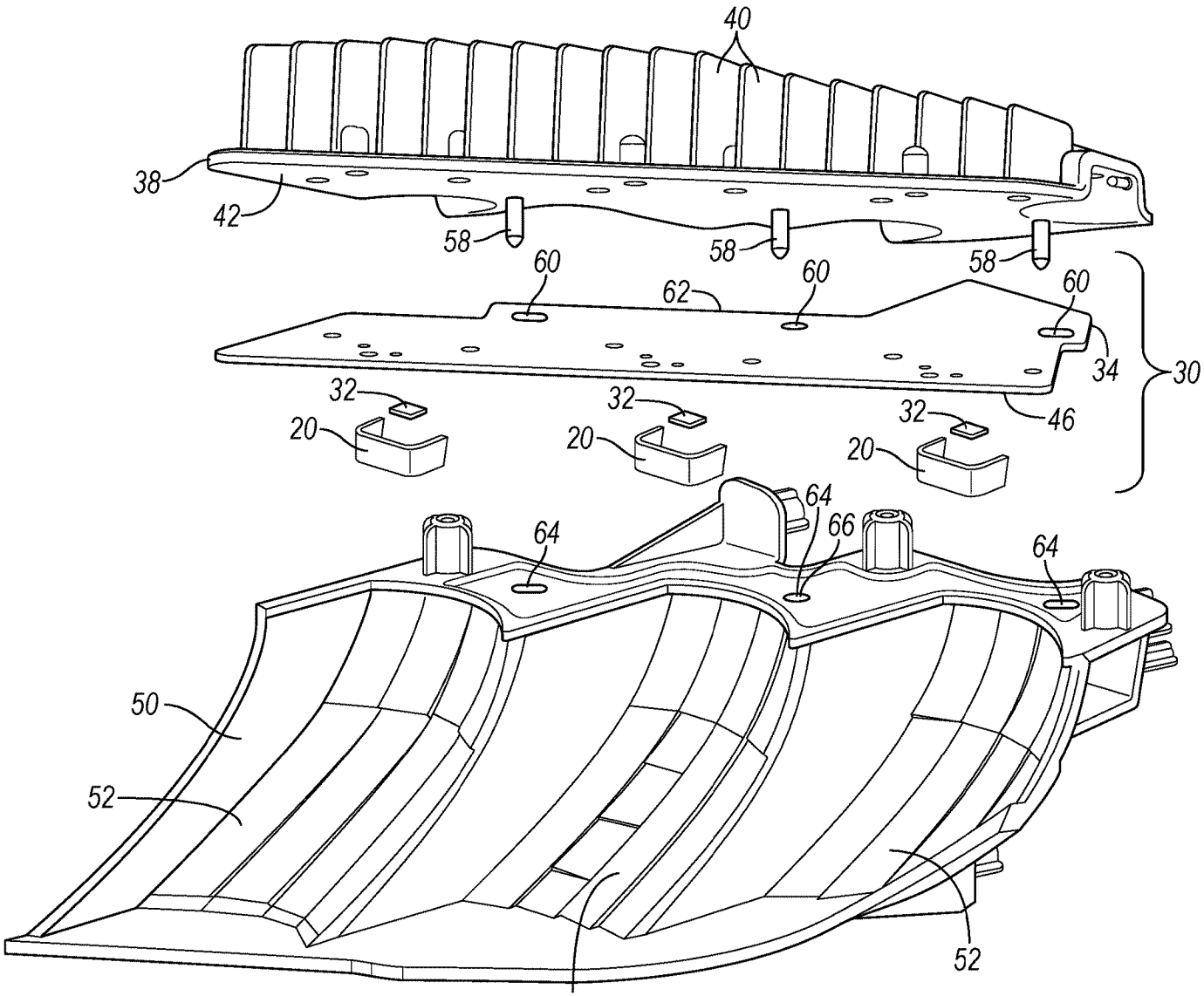
FIG. 1 is an exploded perspective view of a portion of a vehicle lamp having a light shade according to one embodiment.
Figure 2:
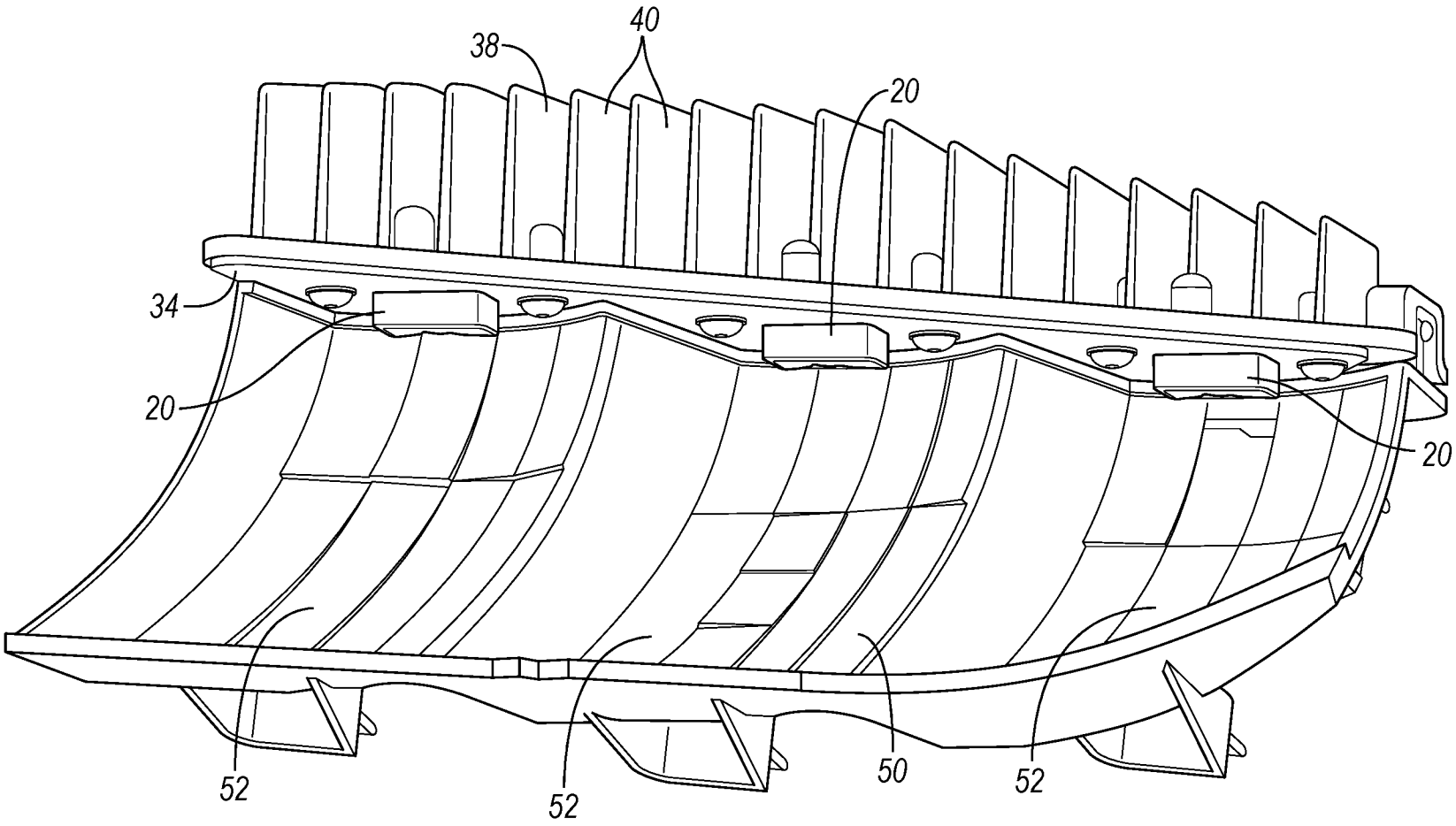
FIG. 2 is an assembled perspective view of the portion of the vehicle lamp in FIG. 1.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-4 illustrate a vehicle lamp 10 having a light shade or shield 20 according to one embodiment. While FIGS. 1-4 illustrate a vehicle head lamp, the vehicle lamp 10 may be a tail lamp, a turn signal lamp, a fog lamp, or any suitable lamp that utilizes a light shade.

The vehicle lamp 10 includes a lamp body 22 having a concave portion defining a front opening 24 of the lamp and a transparent cover 26, or lens, closing the front opening 24 of the lamp body 22. An inner space formed between the lamp body 22 and the cover 26 forms a lamp chamber 28.

The vehicle lamp 10 includes a light source assembly 30 positioned in the lamp chamber 28. The light source assembly 30 includes a light emitting diode (LED) 32, an electrical board 34 and the light shade 20. The LED 32 is mounted to the electrical board 34 and connected to the electric board using solder or other suitable method for connecting components to an electrical board 34.

The LED 32 emits light in response to current supplied at the electrical board 34. The electrical board 34 provides an electrical connection to the LED 32 and the electrical board 34 is connected to a vehicle wiring harness at a connector 36. The wiring harness carries power and control signals transmitted by a vehicle control module to the electrical board 34 to activate the LED 32, for example. The electrical board 34 may a printed circuit board or a flexible circuit board. The printed circuit board may be a metal core board or insulated metal substrate consisting of single or double layer circuit boards laminated on a metal sheet. The flexible circuit board may include a rigidizer for forming a generally rigid electrical board.

The electrical board 34 may be mounted on support 38 to dissipate heat generated by the LED. The support 38 may be a heat sink sufficiently sized to dissipate heat. As illustrated in FIG. 1, the support 38 has a plurality of fins 40 or ribs that dissipate the heat. The support 38 has a support surface 42 on which the electrical board 34 is mounted. The fins 40 extend away opposite the support surface 42.

The light source assembly 30 is arranged so that the LED 32 emits light towards a reflector 50 defined in the lamp chamber 28. The reflector 50 is arranged so that reflection of light rays from the LED 32 is projected toward the lens 26 in a desired light distribution pattern or along a desired emission axis. The reflector 50 may be a parabola-type reflector which has a reflective surface 52 formed based on the revolution of a paraboloid, or any suitable shaped reflector for reflecting light in the desired light distribution pattern based on the type of lamp.

The reflector 50 is positioned adjacent to a top surface 46 of the electrical board 34 and the reflective surface 52 covers the LED 32. The LED 32 may be positioned at the focal point of the reflective surface 52. The reflective surface 52 reflects the light from the LED 32 and irradiates the desired light-distribution pattern toward the lens 26 which projects the light pattern forward.

The direct light emitted by the LED may create glare for a pedestrian or the driver of an oncoming car. So as to not to produce glare, the light shade 20 is positioned adjacent the LED 32 opposite the reflector 50 so that the light shade 20 blocks direct light propagating toward the lens 26. The light shade 20 also blocks scattered or diffuse light from the LED 32 from projecting toward particular regions of the reflector 50 in order to define the desired light-distribution patterns and prevent unwanted light and glare outside the desired light-distribution pattern.

In order to project the desired light-distribution pattern, the LED 32 must be located at a relatively accurate position relative to the reflector 50, such as at the focal point of the reflective surface 52. For example, the LED 32 may be required to be located a predetermined position within a positional tolerance of ±0.3 mm of the focal point of a reflector where the focal point is 15 mm from the reflector 50. Alternatively, the LED 32 may be required to be located at a predetermined position having a positional tolerance of ±0.1 mm to ±0.3 mm.

Likewise and light shade 20 must be located at a relatively accurate position relative to the relative to the LED 32 and the reflector 50 to block direct light while allowing the desired light-distribution pattern. The closer the light shade 20 is located to the LED 32, the greater positional tolerance is required for positioning the light shade 20 at a predetermined location. However, the farther the light shade 20 is located from the LED 32, the light shade 20 blocks more light from the reflector 50 which may adversely affect lamp performance. For example, the light shade 20 may be required to be located at 5 mm from the focal point of the LED 32 at the predetermined position having a positional tolerance of ±0.2 mm. In another example, the light shade 20 may be located at 2.5 mm to the focal point of the LED 32 at the predetermined position having a positional tolerance of ±0.1 mm.

If the light shade 20 can be accurately located relative to the LED 32 with the required tolerances, locating the light shade 20 closer to the LED 32 may improve performance of the lamp 10 while minimizing aesthetic issues with the light shade 20. FIGS. 1-4 illustrate a lamp 10 where the LED 32 and the light shade 20 are oriented accurately at predetermined locations relative to each other on the electrical board 34 without the need for additional connectors, fasteners or other orienting features that have greater tolerance errors.

In some prior art designs, the LED is positioned relative to the reflector based on one locating feature, and then the light shade is positioned relative to the reflector based on a different locating feature. In these prior art designs, the tolerance stack-up based on multiple locating features can cause the light shade to be misaligned with the LED, resulting in undesirable light distribution. Alternatively, to maintain alignment in prior art designs, the multiple locating features each require tight tolerances which result in high costs of all of the components.

The light source assembly 30, including the LED 32 and light shade 20, are accurately located relative to the reflector 50. Locating apertures 60 are formed on the electrical board 34. The locating apertures 60 are formed at relatively accurate locations on the electrical board 34 to function as datum reference points. For example, the locating apertures 60 may each control two-degrees of freedom. As illustrated in FIG. 1, at least one locating aperture 62 may control four-degrees of freedom. The electrical board 34 includes at least two locating apertures 60. As illustrated in FIG. 1, the electrical board 34 includes three locating apertures 60. For example, the locating aperture, 62 may be required to be located with a positional tolerance of ±0.1 mm where the aperture 62 is 3 mm.

Similarly, locating apertures 64 are formed on the reflector 50. The locating apertures 64 are formed at relatively accurate locations on the reflector 50 in order to accurately align the electrical board 34 with the reflector 50. For example, the locating apertures 64 may each control two-degrees of freedom and least one locating aperture 66 may control four-degrees of freedom.

The support 38 includes locating pins 58 that extend from the support surface 42. As illustrated, the locating pins 58 extend generally perpendicular from the support surface 42. The locating pins 58 align and extend through the locating apertures 60, 64 to accurately position the light source assembly 30 relative to the reflector 50. Fasteners, such as screws or bolts, may fasten the extend through fastening features formed on the electrical board 34 and support 38 to secure the electrical board 34 to the support 38.

The LED 32, light shade 20 and locating apertures 60 are accurately located on the electrical board 34 of the light source assembly 30 through the manufacturing and assembly process of the electrical board 34. Electrical boards, such as printed circuit boards are manufactured in an extremely clean environment where the air and components can be kept free of contamination and with automated and robotic equipment and so that circuitry and electrical components can be placed with tight tolerances.

For example, during manufacturing, the electrical board is passed through several machines to drill the locating apertures 60 in the substrate and place the electronic components in their proper location in the circuit. An initial process may form the locating apertures 60 and the locating apertures 60 may then serve as datum reference points for subsequent operations. Further, surface mount technology may be used to mount the LED 32 and light shade 20 to the electrical board at mounting points relative to the locating apertures 60. An amount of solder paste is automatically placed at each mounting point to form a solder pad 68 and then the LED 32 and light shade 20 may be robotically placed at the accurate mounting point. The components are then soldered to the electrical board. With surface mount technology, the soldering may be done by passing the electrical boards through a reflow process, which causes the solder paste to melt and make the connection.

The LED 32 may be electrically connected to the electrical board 34 by any suitable process that accurately and accurately positions the LED 32 in relation to the electrical circuits formed on the electrical board 34. Similarly, the light shade 20 is connected to the electrical board 34 at an accurate predetermined mounting location.

Unlike the LED 32, the light shade 20 is not required to be in electrical communication with any components on the electrical board 34. As such, the mounting location of the light shade 20 may be connected to the electrical board 34 with a mounting feature other than a solder point. For example, the light shade 20 may be connected to the electrical board 34 with an interference fit, such as a snap-fit, where the light shade is snapped into a mounting aperture formed on the electrical board 34.

The automated process of manufacturing the light source assembly 30 results in the accurate placement of the LED 32 and light shade 20 at predetermined locations on the electrical board 34. In particular, the automated placement of the LED 32 and light shade 20 with robotic machines ensures the accurate placement of the LED 32 and light shade 20 relative to locating features 60 on the electrical board 34.

Figure 5:
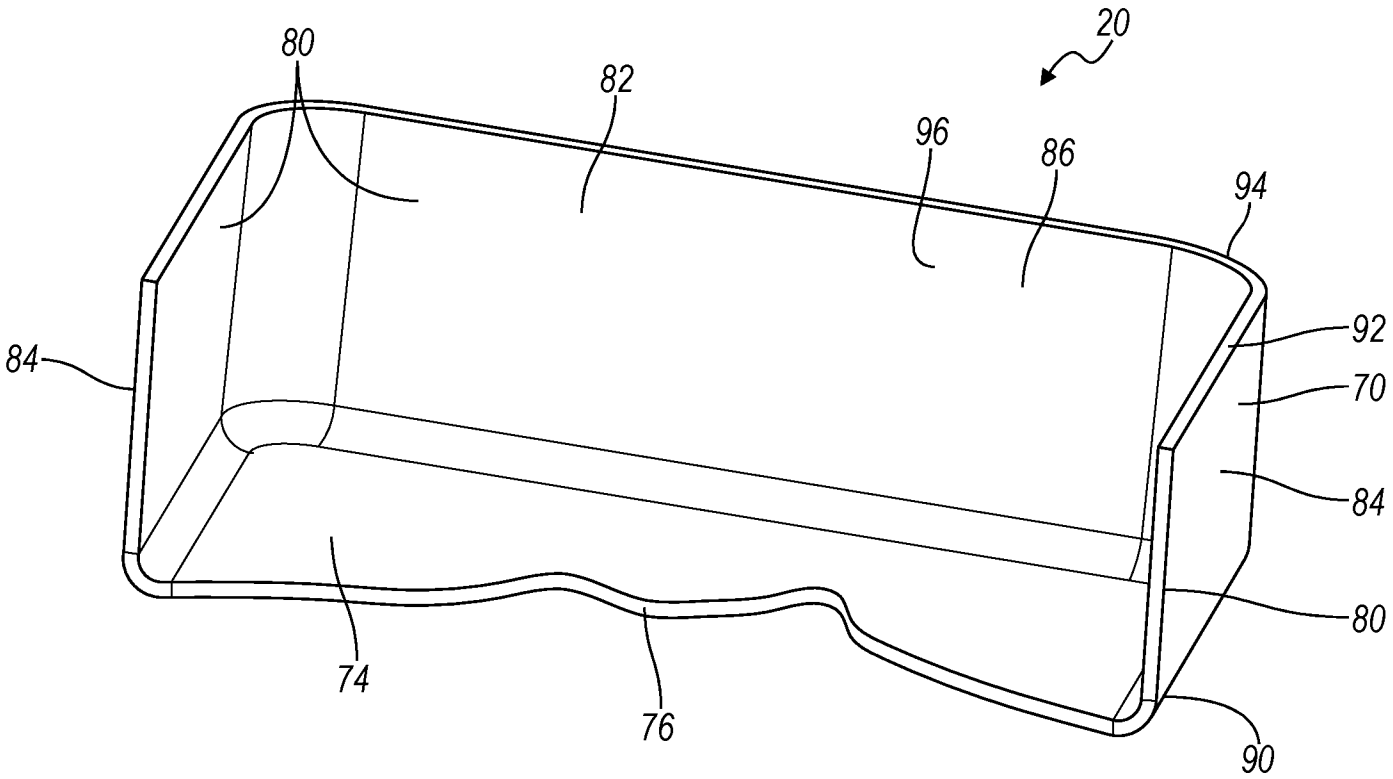
FIG. 5 is a perspective view of the light shade illustrated in FIG. 1.

Turning now to FIG. 5, a detailed view of an example of the light shade 20 is illustrated. The light shade 20 may be stamped or formed from a metal sheet. For example, the light shade 20 may be formed nickel silver ally. The light shade 20 may also be formed of tin plated cold rolled steel or any suitable metal to promote soldering. In one embodiment, the light shade 20 may have a thickness between 0.2 mm and 0.4 mm; however the thickness may vary based on the size and material of the light shade. Furthermore, the metal sheet may be coated on an outer surface 70 to change the appearance or prevent corrosion.

The light shade 20 has a blocking wall 74 for blocking a portion of the light emitted from the LED 32. The blocking wall 74 may include a projection-pattern edge 76 that is contoured to define the desired light-distribution pattern. The contour of the scroll-pattern edge 76 may vary based on the desired light-distribution pattern, the type of LED light source, the shape of the reflector or other design factors. The projection-pattern edge 76 may be oriented at a predetermined distance from a focal point of the LED 32. For example, the projection-pattern edge 76 may be positioned between 2 mm and 8 mm from the focal point of the LED 32. The closer the light shade 20 is positioned to LED 32, the more accurately the light shade 20 must located relative to the LED 32. The further the light shade 20 is positioned away from the LED 32 the light shade is more visible outside the lamp, and the light shade 20 blocks light reflected from the more of the reflector which may affect lamp performance. The distance of the light shade 20 and edge 76 from the LED 32 may vary depending on the design of the lamp, the size of the LED, the desired light distribution pattern or other variables understood by a person of ordinary skill in the art.

The blocking wall 74 is offset from the electrical board by supporting walls 80. As illustrated in FIG. 5, the support walls 80 include a central support wall 82 positioned between lateral support walls 84. The support walls 80 with the blocking wall 74 define a blocking enclosure 86 for blocking undesirable scattered light from the LED 32, while allowing light through a projection opening 88 projected toward the reflector 50. As shown in FIG. 5, the lateral support walls 84 are generally perpendicular to the central support wall 82; however, the support walls 80 may be arranged at angles other than perpendicular. Further, any number or arrangement of support walls 80 may be used to define the blocking enclosure 86 and projection opening 88.

In one embodiment, the central support wall 82 may be approximately 16 mm wide while the lateral support walls 84 are approximately 10 mm long. The support walls 80 are approximately 6 mm high, thereby offsetting the blocking wall 74 from the electrical board 34 by the height of the support walls 80.

The blocking wall 74 is connected to a first end 90 of the support walls 80 to define the enclosure 86. As illustrated in FIG. 5, the blocking wall 74 is generally perpendicular to the support walls 80. A distal end 92 of the support walls 80 defines a contact surface 94 for contacting the electrical board 34. The contact surface 94 may be generally planar to correspond with the top surface 46 of the electrical board 34. The contact surface 94 may also be shaped to correspond with a mounting feature formed on the electrical board 34.

In one embodiment, an inner surface 96 of the light shade 20 is disposed adjacent the LED 32 and has an anti-reflective surface to further prevent scattered light from being reflected in an undesirable pattern. For example, the inner surface 96 may be coated with dielectric coating or etched to create an anti-reflective and scattering surface.

Figure 3:
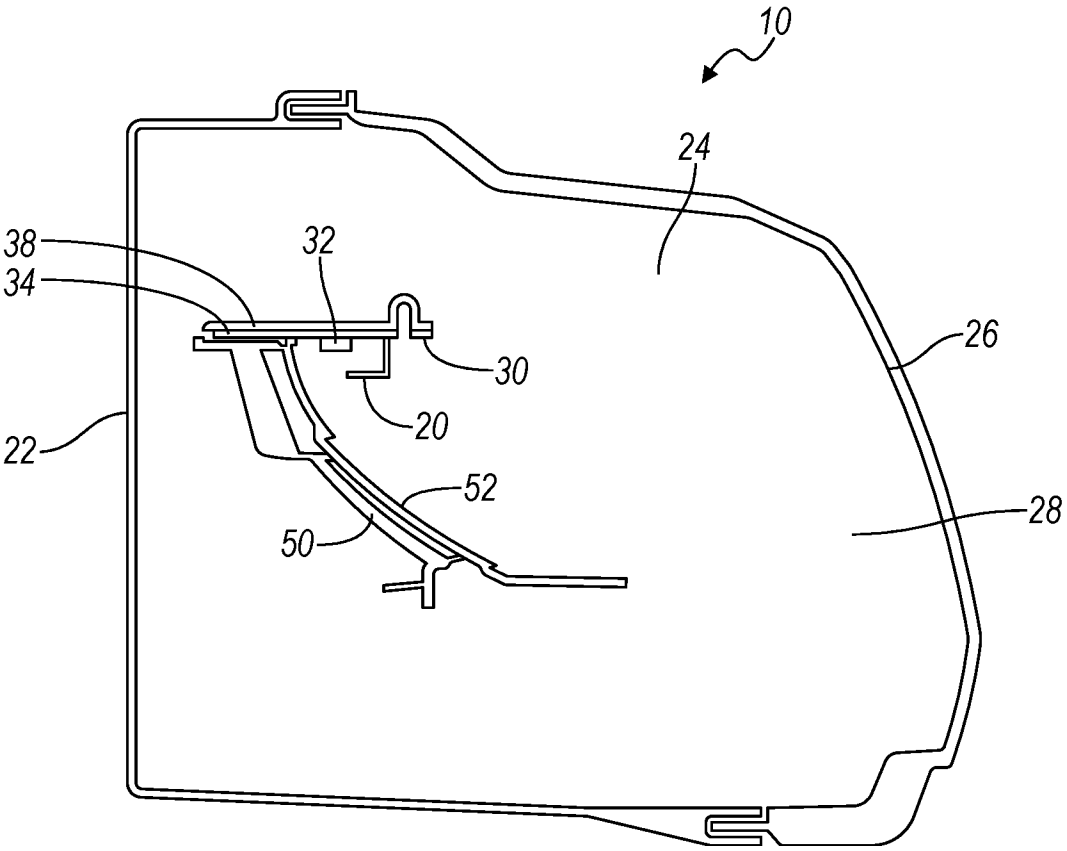
FIG. 3 is a side section view of the assembled vehicle lamp.
Figure 4:
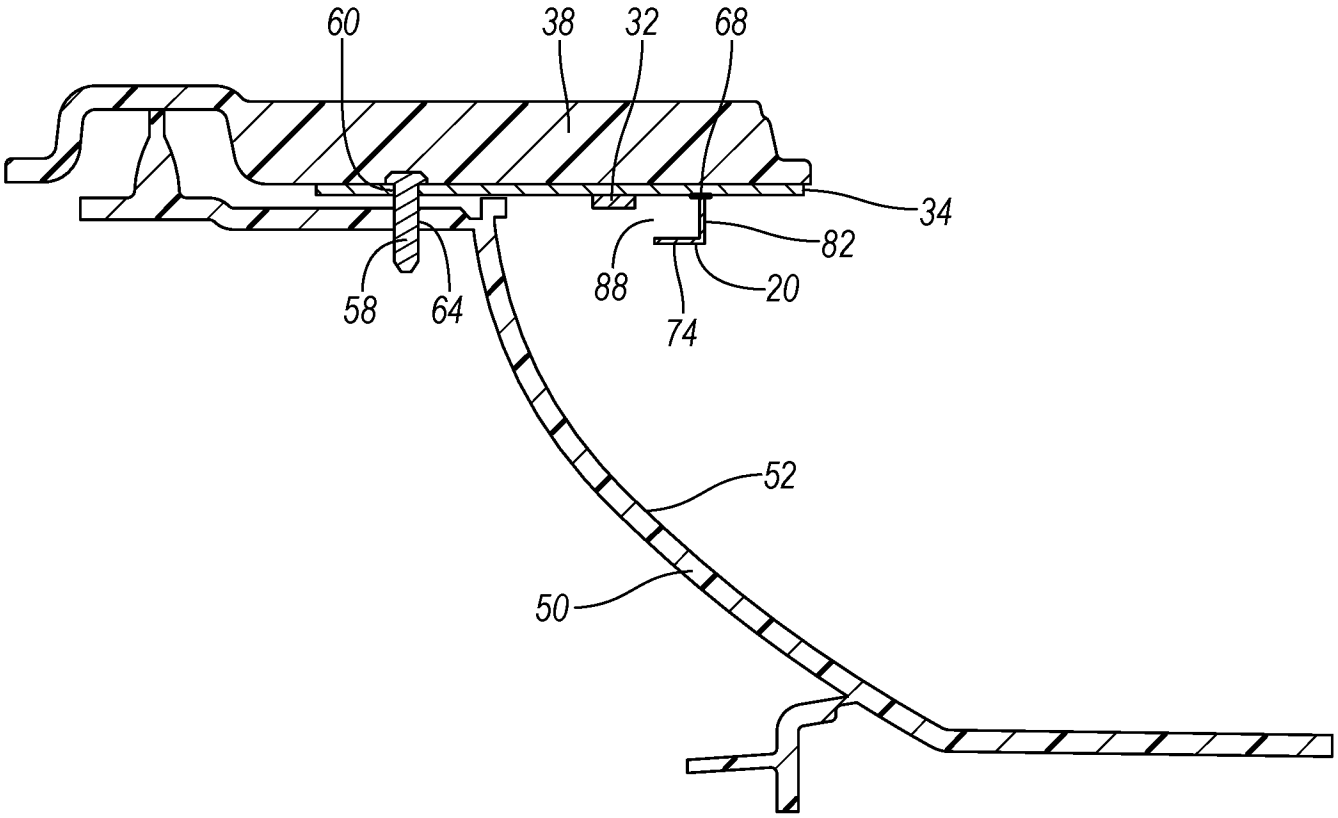
FIG. 4 is a side section view of the assembled portion of the vehicle lamp illustrated in FIG. 1.

As shown in the section view in FIG. 3, when the light shade 20 is mounted on the electrical board 34, the central support wall 82 is facing the lens 26. Similarly, the projection opening 88 is generally facing the reflector 50. The blocking wall 74 is offset and generally parallel to the electrical board 34, as illustrated in FIG. 3; however in some embodiments the blocking wall 74 may be formed at an angle other than parallel to the electrical board 34.

As illustrated in FIG. 3, when the light shade 20 may be mounted on the electrical board 34 so that the blocking wall 74 does not overlap the LED 32. In another embodiment, the light shade 20 may be mounted on the electrical board 34, so that the blocking wall is between 5 mm and 20 mm from the LED 32. The light shade 20 may be positioned so that the LED 32 is centered between the lateral support walls 84. The central support wall 82 is facing the lens 26. Similarly, the projection opening 88 is generally facing the reflector 50. The blocking wall 74 is offset and generally parallel to the electrical board 34, as illustrated in FIG. 3; however in some embodiments the blocking wall 74 may be formed at an angle other than parallel to the electrical board 34.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle lamp comprising:

a housing;

a transparent lens connected to the housing to define a lamp chamber there between;

a reflector disposed in the lamp chamber for reflecting light through the lens;

an electrical board disposed in the lamp chamber and oriented relative to the reflector;

a light emitting diode (LED) mounted to the electrical board for emitting light; and a light shade formed of metal having an anti-reflective inner surface positioned adjacent to the LED to prevent light from being reflected from the inner surface, wherein the light shade is soldered to the electrical board at a predetermined orientation relative to the LED to block light rays emitted by the LED, wherein the light shade forms an enclosure having at least two support walls soldered to the electrical board and a blocking wall offset from the electrical board by the support walls, the blocking wall having a projection-pattern edge, wherein a first portion of light from the LED is projected past the projection-pattern edge toward the reflector and a second portion of light is blocked by the blocking wall, wherein each of the support walls are soldered to the electrical board via at least one solder pad defined on the electrical board, wherein the light shade is oriented relative to the reflector based on a position of the solder pad.

2. The vehicle lamp according to claim 1 wherein the light shade does not contact the reflector.

3. The vehicle lamp according to claim 1 wherein the reflector has a locating feature;

wherein the electrical board has a corresponding locating feature; and wherein the light shade is oriented relative to the reflector based on the position of the solder pad on the electrical board by aligning the locating feature on the electrical board with the corresponding locating feature on the reflector.

4. The vehicle lamp according to claim 1 wherein the electrical board is a printed circuit board.

5. The vehicle lamp according to claim 1 wherein the at least two support walls comprise three support walls comprising a central support wall positioned between two lateral support walls, wherein the three support walls are soldered to the electrical board along contact surfaces opposite the blocking wall.

6. The vehicle lamp according to claim 1 wherein the light shade has an outer surface finished to appear similar to a reflector surface.

7. The vehicle lamp according to claim 1, wherein the LED is oriented relative to the reflector by aligning a locating feature on the electrical board with a corresponding locating feature on the reflector, wherein, wherein the predetermined orientation of the light shade is determined based on the locating feature on the electrical board.

8. A vehicle lamp comprising:

a housing;

a transparent lens connected to the housing to define a lamp chamber there between;

a reflector disposed in the lamp chamber for reflecting light through the lens, the reflector having a locating feature;

a light assembly disposed in the lamp chamber and comprising:

an electrical board oriented relative to the reflector by aligning a corresponding locating feature on the electrical board with the locating feature on the reflector;

a light emitting diode (LED) disposed in the lamp chamber and mounted to the electrical board; and a light shade formed of metal having an anti-reflective inner surface positioned adjacent to the LED to prevent light from being reflected from the inner surface, wherein the light shade is soldered to the electrical board at a mounting feature defined at a predetermined location relative to the LED to block light rays emitted by the LED, wherein the light shade does not contact the reflector, wherein the predetermined location of the light shade is determined based on the locating feature on the electrical board, wherein the light shade forms an enclosure having a blocking wall offset from the electrical board and is not soldered to the electrical board and having at least two support walls extending from the blocking wall and soldered to the electrical board along distal edges of the support walls.

9. The vehicle lamp according to claim 8 wherein the locating feature on the reflector and the corresponding locating feature on the electrical board comprise mounting apertures.

10. The vehicle lamp according to claim 9 further comprising a support structure having a locating pin extending therefrom, wherein the locating pin extends through and aligns the mounting apertures to position the LED and light shade relative to the reflector.

11. A light assembly, comprising:

an electrical board adapted to be oriented relative to a reflector;

a light emitting diode (LED) mounted to the electrical board; and a metal shade having an anti-reflective inner surface positioned adjacent to the LED to prevent light from being reflected from the inner surface, and the medal shade soldered to the electrical board with metallic solder at a predetermined orientation relative to the LED wherein the shade forms an enclosure that partially blocks light from the LED from projecting outside the enclosure, wherein the enclosure has at least two support walls soldered to the electrical board and a blocking wall offset from the electrical board by the support walls, the blocking wall having a projection-pattern edge, wherein a first portion of light from the LED is projected past the projection-pattern edge toward the reflector and a second portion of light is blocked by the blocking wall, wherein each of the support walls are soldered to the electrical board via at least one solder pad defined on the electrical board, wherein the light shade is adapted to be oriented relative to the reflector based on a position of the solder pad.

12. The light assembly according to claim 11, wherein the blocking wall is offset from the electrical board and is not soldered to the electrical board.

13. The light assembly according to claim 11, wherein the projection-pattern edge is oriented at a predetermined distance from a focal point of the LED.

14. The light assembly according to claim 11, wherein the enclosure is defined by at least three support walls extending from the blocking wall, wherein the three support walls comprise a central support wall positioned between two lateral support walls, wherein the three support walls are soldered to the electrical board along contact surfaces opposite the blocking wall.

15. A method of assembling the light assembly of claim 11 comprising:

placing, with a robotic machine, the light emitting diode (LED) on the electrical board at a first mounting feature; and placing, with the robotic machine, the metal shade on the electrical board at a second mounting feature at the predetermined orientation relative to the first mounting feature.

16. The method of assembling the light assembly according to claim 15, further comprising soldering the LED and metal shade to the electrical board.

* * * * *